United States Patent [19]

Coverston

[11] 4,054,619

[45] Oct. 18, 1977

[54] ATOMIZING AND MIXING APPARATUS

[76] Inventor: George C. Coverston, 76 S. Russell, Fallon, Nev. 89406

[21] Appl. No.: 444,913

[22] Filed: Feb. 22, 1974

[51] Int. Cl.[2] ..... B01F 3/04

[52] U.S. Cl. ..... 261/24; 261/78 R; 261/78 A

[58] Field of Search ..... 261/78 A, 78 R, 28, 261/24

[56] References Cited

U.S. PATENT DOCUMENTS

| | | | |
|---|---|---|---|
| 1,219,568 | 3/1917 | LeLarge | 261/78 R |
| 1,535,702 | 4/1925 | Walsh et al. | 261/78 R |
| 2,094,959 | 10/1937 | Pulidori | 261/78 R |
| 2,227,267 | 12/1940 | Lozivit | 261/DIG. 51 |
| 2,661,195 | 12/1953 | Van Bemmel et al. | 261/78 R |
| 2,715,045 | 8/1955 | Thompson | 261/78 A |
| 2,805,966 | 9/1957 | Etheridge | 261/78 A |
| 2,899,185 | 8/1959 | Rector | 261/78 R |
| 3,134,825 | 5/1964 | Sexton | 261/78 A |
| 3,287,001 | 11/1966 | Harris | 261/78 A |
| 3,368,645 | 2/1968 | Hoffman et al. | 261/78 R |

FOREIGN PATENT DOCUMENTS

| | | | |
|---|---|---|---|
| 73,780 | 9/1960 | France | 261/78 R |
| 936,817 | 9/1963 | United Kingdom | 261/78 A |

*Primary Examiner*—Tim R. Miles
*Attorney, Agent, or Firm*—Herbert C. Schulze

[57] ABSTRACT

This invention is an apparatus for atomizing and mixing substances with a carrier gas. The invention is particularly characterized by increasing the speed and decreasing the static pressure of the gas by drawing it through a suitable throat arrangement in combination with a metering device for the substance to be atomized, wherein such substance to be atomized is taken into the said gas in such manner that the substance disperses within said gas along an expanding surface thus creating maximum atomization, impregnation, and dispersion of the gas and substance.

1 Claim, 7 Drawing Figures

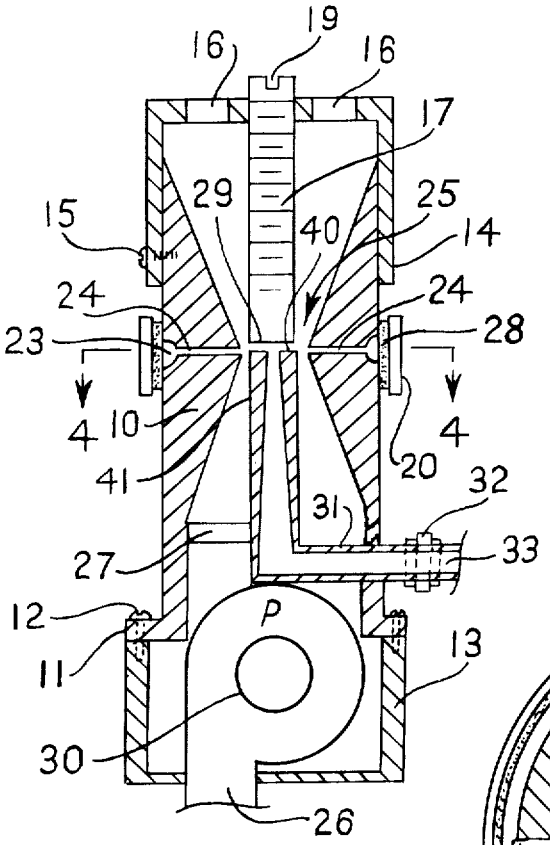
FIG. 3
FIG. 4
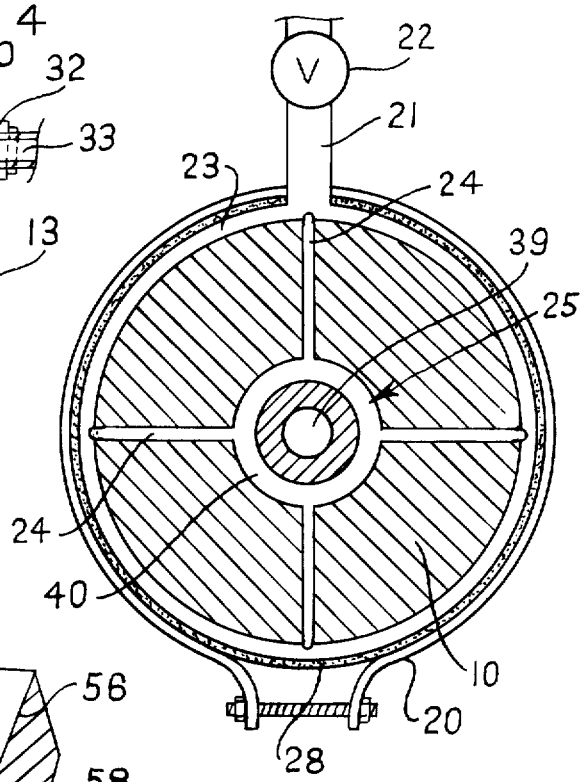
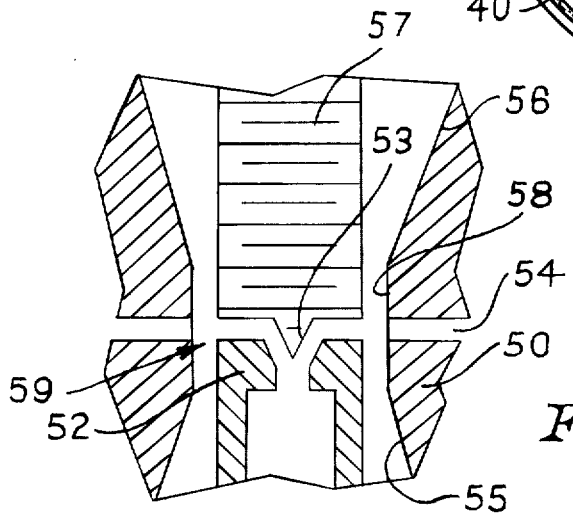
FIG. 5

ATOMIZING AND MIXING APPARATUS

BACKGROUND OF THE INVENTION

1. Field of the Invention

This invention is in the general field of atomizing and mixing apparatus for substances, such as aerosols or the like. It has been my purpose more importantly to invade the field of combustible materials as the substances being atomized and the invention is in the general field of atomizing and mixing apparatus, one important aspect of which is the field of energy releasing equipment such as furnaces, into which fuels are injected.

2. Description of the Prior Art

There is a great volume of prior art in the general fields of atomization of various substances, including such items as combustible materials. Particularly in relation to combustible materials there have been many developments in the fields of carburetion and in carburetors particularly for use with internal combustion engines and the like. A complete review of all of the field of art of this nature would be unduly lengthy and would serve no purpose, as the present invention is a device to supersede carburetors and is in a unique and hitherto unexplored field of the dispensing of the substance to be atomized and intermixed with an incoming stream of gas at and/or near a throat area of maximum acceleration of the gas from which the substance and the gas pass into a deceleration and increasing suction zone for further conduct into the suction inlet of a motivated compressor or through the throttle valve utilizing the draft of a combustion device. The invention is unique in this aspect and there is no known prior art.

SUMMARY OF THE INVENTION

In the use of fuels of virtually all types, and in certain other restricted uses and applications, it is common to provide a substance, such as gasoline, suitable to be dispersed into a gas such as air. The substances are normally referred to as aerosols and are customarily dispersed within the gas by some type of fine spray or the like. Many devices for accomplishing such results, particularly in the field of fuels are known. I have made a complete study of this field and of the general dispersing of aerosols and other substances into air and other gases.

It is generally known that in the operation of energy consuming devices, such as furnaces, engines and the like, that great amounts of the fuel will not be consumed and will escape into the atmosphere. In some cases, it is believed that as much as 85% of the actual fuel is not utilized. Such ineffective consumption of the fuel results in a high loss of efficiency, greatly increased use of fuels or the like, high rates of air pollution, and many deleterious effects upon the energy consuming device itself.

In studying the situation I have ascertained that the problem is always characterized by a "wet" fuel mixture in which the fuel actually exists as droplets, particles, or the like rather than as a fully atomized and mixed material. Addressing myself to this problem I discovered that in the ordinary situation where fuel is intermixed with a gas by a spray or the like, it continues to be so carried rather than being totally converted into volatile microscopic particles.

I have found that I am able to combine an apparatus for the acceleration of the carrying gas accompanied by a decrease in the static pressure thereof at a throat arrangement which can be for example an annular, curved, or straight venturi or the like. When I then provide a substance dispersion surface arrangement for the material at this point, where the carrier gas commences to decelerate, expand, and depressurize, I achieve a complete atomization and mixing of the substance.

I have found that liquid materials, such as gasoline or the like, are properly affected by my device. Additionally, other substances, and particularly energy releasing substances such as coal, magnesium, and the like, if finely divided can be carried in this manner to an energy releasing zone or utilization zone for virtually complete combustion. In many cases, such as in furnaces, this will result in the elimination of costly stacks or the like used to dispose of the impurities.

It is an object of this invention to provide an apparatus suitable to draw a carrier gas into the apparatus and to disperse a substance into the apparatus in such manner that they are impregnated with one another and intermixed within the apparatus and drawn completely therethrough by a means suitable to draw gases through a confined area.

Another object of this invention is to provide a means for more perfect dispersion of a substance within a carrier gas.

Another object of this invention is to provide a means for dispersion of an energy releasing substance within a carrier gas in such manner as to result in more complete release of the energy.

Another object of this invention is to provide a means for dispersing a substance into a carrier gas at a point of deceleration, expansion and pressure reduction of the carrier gas.

Another object of this invention is to provide such a device in which water or other materials may be intermixed with the carrier gas and other substance.

Another object of this invention is to provide an apparatus for mixing combustible materials with a carrier gas and then passing same under pressure into a combustion zone for combustion.

The foregoing and other objects and advantages of this invention will become apparent to those skilled in the art upon reading the description of a preferred embodiment which follows, in conjunction with the appended drawings.

BRIEF DESCRIPTION OF THE DRAWINGS

FIG. 3 is a section on 3—3 of FIG. 1;

FIG. 4 is a section on 4—4 of FIG. 3;

FIG. 5 is a broken away partial section of an alternate embodiment of the constricted area and substance dispensing device for use in this apparatus;

DESCRIPTION OF A PREFERRED EMBODIMENT

Figures 1, 2:
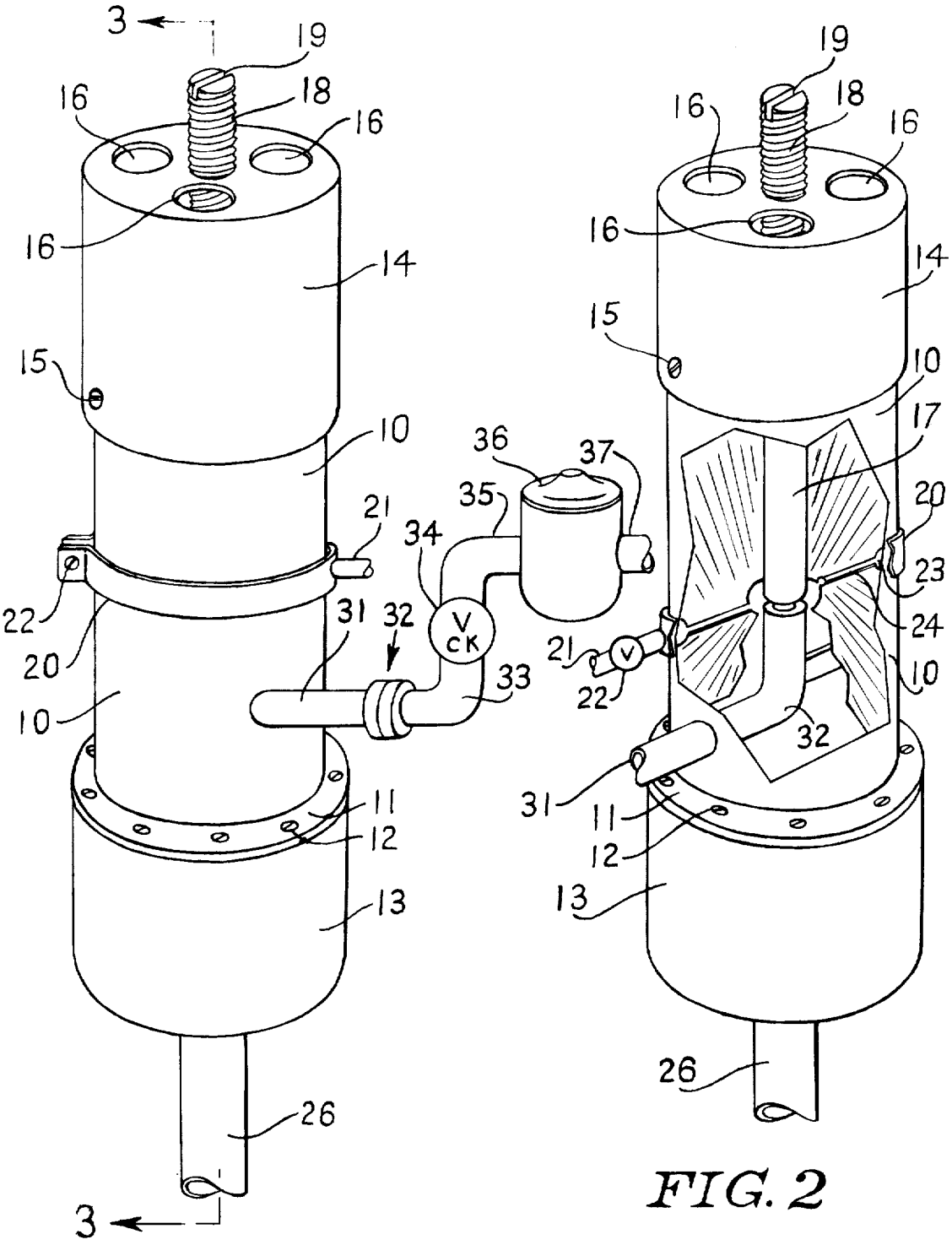
FIG. 1 is a perspective of a preferred embodiment of this invention.
FIG. 2 is a view similar to FIG. 1 with certain portions broken away.

The device of this invention is composed of a single venturi effect producing device 10 formed from any suitable material such as aluminum, plastic, or the like.

One end of the venturi effect producing device is provided with a flange 11 which may be fastened to a pump housing or the like 13, or for example it may be fastened to a manifold of an engine replacing a carburetor which might otherwise have been used with such engine and attached to such manifold in customary manner.

A cap 14 may be threaded upon the venturi effect producing device 10 or may be held in place by a set screw or the like 15. The cap will be of any suitable material such as aluminum or the like and will be provided with a number of openings 16 which will allow the entry of air or other gas. A rod 17 of relatively rigid material is provided, and is in threaded connection with a threaded hole in the cap. A portion of the rod will normally be threaded at 18, or other means of lineal adjustment with relation to the cap can be provided. Where a threaded arrangement is used, a slot 19 or the like will be provided for the purpose of adjustment of the lineal position of the rod.

A clamp or the like 20 having a conduit 21 attached thereto is provided and is held in position by a screw or the like 22 in a customary clamping manner. The clamp is provided to cover, with suitable gasket material if required, a groove 23 about the circumference of the venturi effect producing member.

A plurality of radial holes will be provided interconnecting between groove 23 and the inner orifice 25 formed in the venturi effect producing element.

A valve 22 will control the flow of material which will enter beneath the clamp and into the groove for dispersion into the venturi orifice.

A pipe or the like 31 will be provided to supply the substance to be atomized and mixed to the interior of the device. This pipe 31 will be connected by a union or the like 32 to another pipe 31, in order that the entire device may be rotated into any desired angular position. A valve or the like 34 will be connected in customary manner between the pipe 33 and another pipe 35 in turn connected to a filter, reservoir, or the like 36 as may be desired depending upon the substance being introduced into the device. An additional pipe 37 will lead to a source of the substance being utilized in the device. The substance supplying conduit 31 will be angularly arranged within the device so as to terminate in axial alignment with the venturi effect producing arrangement and so as to terminate at approximately the throat of the venturi arrangement.

A dispensing conduit 26 is provided from the pump housing for ultimate dispensing of the material being atmized and mixed in the device as will be hereinafter explained.

Particular attention should now be paid to FIG. 3 where the elements are clearly shown in a sectional relationship. The venturi device 10 may be of one piece having a wide mouth at each end and a constriction at the area 25. The cap 14 is held in position with the screw 15, and the rod 17 is threadedly connected to the cap 14 so it may be adjusted in such manner that its flat end 29 comes closer or farther away from the constricted area 25 and the substance dispensing surface 40 and 41 which will be described below.

The clamp 20 around gasket 28 forms a sealed passageway 23 which will be interconnected with the pipe which passes through the clamp 20 and the gasket 28 in a manner which will be understood by those skilled in the art and which has not been illustrated.

The passages 24 interconnect with the conduit 23 around the device and thus provide a multiplicity of channels for the substance flowing in the area 23 to enter into the orifice area 25. The flange 11 is held in contact with the pump housing 13 by a number of screws or bolts 12 as will be understood by those skilled in the art. The housing 13 contains a pump (such as an air pump or the like) which will draw materials from the housing and expel them under pressure through the conduit 26.

A brace or the like 27 has been provided, for use if desired, to hold the substance conduit 31 in firm relationship to the balance of the device.

It will be noted that the substance conduit 31 has a tapered and gradually decreasing inner configuration terminating in a flat shoulder 40. The exterior surface 41 will normally be a straight surface as indicated although could take other forms without departing from the invention herein.

When desired, the pump housing 13 together with its pump may be removed, and the flange 11 may be fastened to some other device suitable to accept and utilize the materials being intermixed in this device. As an example, this might be mounted on a vacuum manifold or the like wherein the materials would be drawn directly into such manifold. This will be understood by those skilled in the art.

FIG. 4 illustrates the manner in which the groove 23 about the circumference of the venturi effect producing device interconnects with a series of drilled holes or the like 24 and with conduit 21 controlled by valve 22 through which an additional material may be dispensed into the constricted area 25. This figure also shows the relationship of the substance introduction orifice 39 to the surrounding shoulder 40.

Alternate embodiments are illustrated, not for purposes of limitation, but for showing the flexibility of this system and some of the changes in configurations of the interior areas which might be utilized for differing effects.

FIG. 5 shows an alternate embodiment in which the venturi effect producing device 50 has converging surfaces 55 and 56, with a flat orifice area 58 producing an extended constriction zone. Additionally, the ends of the substance supply and the control rod have taken a different form as at 52 and 53 so as to have a shape somewhat similar to a needle valve, wherein the substance can be cause to flow in a somewhat different pattern of constriction than in the first embodiment shown. The needle end 53 is carried on the end of rod 57 which is adjustable with relation to the substance feed end 52. The area between the two, generally 59 may be reduced or enlarged in this manner. The conduits 54 will serve the function similar to the conduits 24 as illustrated in the FIG. 4.

Figure 6:
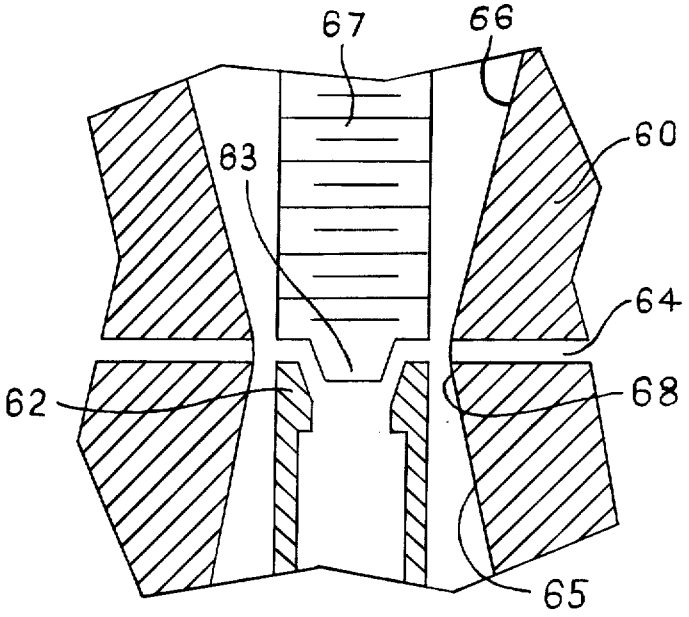
FIG. 6 is an alternative embodiment of the constricted area and substance dispensing device for use in this apparatus.

FIG. 6 illustrates still another ambodiment in which the venturi effect producing device 60 has converging sides 65 and 66 which finally come together in a curved sectional relationship 68, thus creating a different flow effect in the constricted area.

The conduit 64 again performs the function similar to 24 as shown in FIG. 4, and a different substance emitting arrangement is provided wherein a device somewhat similar to a needle valve, but having a flattened surface is provided on the end of adjustable rod 67 with a matching configuration on the substance dispensing orifice formed by the configuration as at 62.

Figure 7:
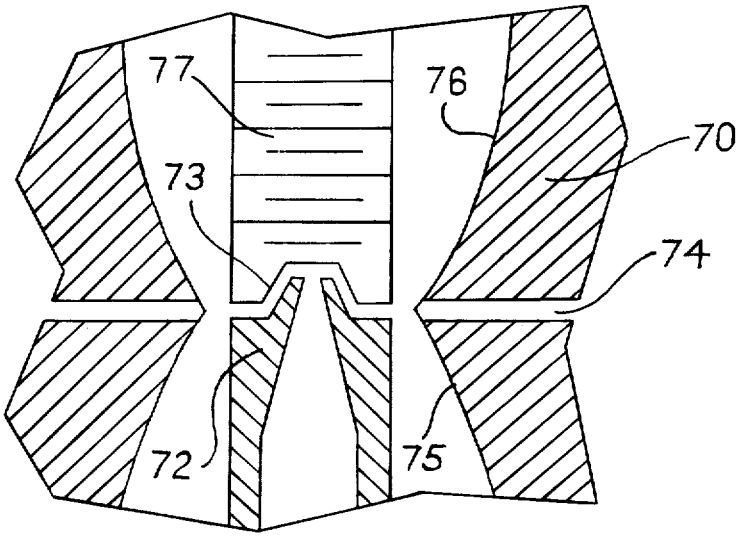
FIG. 7 is another alternative embodiment of the constricted area and substance dispensing device for use in this apparatus.

Another variation is illustrated in FIG. 7 wherein the venturi effect producing device 70 has curved surfaces 75 and 76 converging as indicated with the conduits 74 performing the functions similar to conduits 24 of FIG. 4. The substance introducing device is materially altered here wherein the substance feed device has a configuration essentially as indicated and the adjustable rod 77 has a matching configuration in an inverted manner wherein the substance is drawn upward and into the cavity and then downward over the substance dispensing surfaces.

It is understood that the device will be basically as shown in FIGS. 1, 2, 3, and 4 in conjunction with the use of the alternate embodiment, it being recognized that the alternate embodiments may be also interchanged so that there may be a multiplicity of combinations.

For example, the fuel dispensing orifice and rod end of any of the FIGS. 3, 5, 6 or 7 might be interchanged in the complete device as illustrated in FIG. 3 and likewise the body arrangements 10, 50, 60, and 70 would be inter-changeable in configuration.

In operation of the device the pump 30 will be activated and will pump materials, which it must obtain from the venturi effect producing device, under pressure through its outlet conduit 26.

When the pump is activated it will be clear that it is then causing air, or any other gas to which the opening 16 may be interconnected to be drawn into the device. This gas will, of course, accelerate as it reaches the constricted area 25, and as it passes that area it will expand and decelerate as well as undergo a repressurization.

The fuel or other substance being utilized will be admitted through the conduit 33 and will flow over the surface 40 and around the surfaces 41 so that it will be drawn into the gas and will be atomized and mixed. In effect, the change of acceleration and pressures of the gas will cause the substance being introduced to break down completely and become totally atomized and intermixed.

When desired, an additional substance, for example water, steam, oxygen, or a variety of other materials may be supplied under pressure through valve 22 and conduit 21 so as to fill the groove 23 and the feed holes 24. By control of the valve, the amount of said additional material may be controlled and it will also enter the mixing process in a manner similar to the substance entering in the center of the device. In this manner an intimate atomized mixture of all of the materials desired may be achieved. This mixture then passes into the pump area and is forced under pressure by the pump through the outlet 26 to the combustion or other utilization zone whatever it may be. Such zone could be a furnace, an engine, or could even be at the end of a nozzle or other appropriate zone wherein the material is to be used.

While it was stated that it was deemed preferable to use a pump for the purpose of full utilization of this invention, it will be understood that some other arrangement by which the intermixed material is drawn out may be conceived.

While the embodiments of this invention shown and described are fully capable of achieving the objects and advantages desired, it is to be understood that such embodiments are for purposes of illustration only, and are not for purposes of limitation.

I claim:

1. A device for intermixing a carrier gas and a first substance to be carried thereby so as to impregnate one with the other, and for introducing a second substance into said carrier gas and first substance mixture, comprising: A elongated hollow tubular member in which said hollow tubular member is constricted intermediate its ends; means adjacent the first end of said tubular member so adapted to admit gas into said tubular member; control means adjustably fastened within said first end so as to allow adjustable positioning of one end of said control means with respect to the constricted portion to the tubular member; First conduit means entering said tubular member adjacent the second end of said tubular member, said first conduit means terminating in a substance dispersal surface adjacent the constricted portion of the tubular member; A channel circumferentially surrounding the exterior of said tubular member; second conduit means interconnecting said channel and the interior of said tubular member at the constriction thereof; said second conduit means connected to said channel suitable to supply a substance thereto; Means adjacent the said second end of said elongated member for extracting gases therefrom and for drawing, as a function of said extraction, other gases into said member through the gas admitting means adjacent said first end of said tubular member; and gas supply means for said gas admitting means; First substance supply means for first conduit; and second substance supply means for said second conduit.

* * * * *